US005907756A

United States Patent [19]

Shirota et al.

[11] Patent Number: 5,907,756

[45] Date of Patent: May 25, 1999

[54] TONER REPLENISHMENT DEVICE AND TONER BOTTLE

[75] Inventors: Mihoko Shirota; Masanori Hara, both of Aichi-Ken, Japan

[73] Assignee: Minolta Co., Ltd., Osaka, Japan

[21] Appl. No.: 08/905,391

[22] Filed: Aug. 4, 1997

[30] Foreign Application Priority Data

Aug. 7, 1996 [JP] Japan ..... 8-208213
Aug. 7, 1996 [JP] Japan ..... 8-208214

[51] Int. Cl.[6] ..... G03G 15/08

[52] U.S. Cl. ..... 399/262; 222/169; 222/DIG. 1

[58] Field of Search ..... 399/262, 263, 399/258, 120; 222/DIG. 1, 167, 169, 172

[56] References Cited

U.S. PATENT DOCUMENTS

| | | | |
|---|---|---|---|
| 4,878,603 | 11/1989 | Ikesue et al. | 222/167 |
| 5,296,900 | 3/1994 | Saijo et al. . | |
| 5,528,349 | 6/1996 | Satake | 399/262 |
| 5,557,382 | 9/1996 | Tatsumi et al. | 399/262 |
| 5,572,301 | 11/1996 | Shiratori | 399/234 |
| 5,581,334 | 12/1996 | Forlani et al. | 399/263 |
| 5,722,020 | 2/1998 | Matsuoka et al. | 399/262 |
| 5,734,953 | 3/1998 | Tatsumi | 399/262 |
| 5,740,506 | 4/1998 | Sundquist et al. | 399/262 |
| 5,794,108 | 8/1998 | Yoshizawa et al. | 399/262 |

*Primary Examiner*—Robert Beatty
*Attorney, Agent, or Firm*—Burns, Doane, Swecker & Mathis, L.L.P.

[57] ABSTRACT

A toner bottle has a concavity on one endface, connector ribs are provided on the interior wall of the concavity. A drive system is provided with a torque limiter and a retraction mechanism for retracting a drive member in an opposite direction from the toner bottle when there is insufficient connection between the toner bottle and the drive member. Accordingly, the drive system is not damaged when a user mistakenly rotates an installed toner bottle. A drive member for connection with ribs of the toner bottle, and a drive shaft for transmitting a rotational force to the drive member and a coupling also provided. At least two connector projections are provided on the toner bottle to engage connectors provided on the coupling. The coupling is rotated to a predetermined fixed position and stopped via a sensor when a toner bottle is not installed, so that when a user inserts a toner bottle into the coupling, connection between the toner bottle and the coupling is possible only at the predetermined position.

24 Claims, 6 Drawing Sheets

TONER REPLENISHMENT DEVICE AND TONER BOTTLE

BACKGROUND OF THE INVENTION

1. FIELD OF THE INVENTION

The present invention relates to a replenishment device and bottle for replenishing powder within said bottle to a device which requires said powder.

The present invention further relates to a toner replenishment device for resupplying toner to a developing device in an image forming apparatus such as a copier, printer and the like, and a toner bottle for use in said device.

2. DESCRIPTION OF THE RELATED ART

In image forming apparatuses such as copiers, printers and the like, the user must perform the job of resupplying toner to a toner replenishment device because toner is consumed during image formation. Since toner is typically comprised of particles several microns in size, disadvantages arise inasmuch as airborne toner dispersion causes soiling of the surrounding area during the operation of moving toner from a toner container to the toner replenishment device. Conventionally, a toner bottle containing toner is installed in the toner replenishment device, and the toner replenishment device allows replacement of the toner bottle.

The disadvantage of soiling the surrounding area also arises during toner bottle replacement when the toner bottle is turned over so as to have the mouth of the toner bottle on the bottom when inserting an arm into the toner bottle to scrape the toner accommodated therein in order to move the toner accommodated within the toner bottle to the toner replenishment device.

U.S. Pat. No. 5,296,900 discloses art wherein a spiral channel is provided along the interior surface of a toner bottle so as to utilize the transport force of the toner bottle itself to supply toner from an opening at one end of a toner bottle by rotating the toner bottle.

Furthermore, Japanese Patent No. 6-95248 discloses art wherein an opening is provided on the endface of a bottle cylinder and the toner bottle having a spiral guide is engaged to a coupling and said coupling is rotated by a motor to replenish toner.

In the conventional toner replenishment device disclosed in U.S. Pat. No. 5,296,900, there is a possibility of damaging the drive system due to a rotational load generated from the toner bottle to the drive unit when a user rotates the toner bottle because the drive unit and toner bottle are connected via a linkage unit. Furthermore, damage may result when the toner bottle is improperly rotated before it is completely seated so as to force it into position.

The addition of a damage prevention mechanism within the drive system to eliminate the aforesaid problems is inconvenient from the perspective of the construction of the image forming apparatus inasmuch as such an addition will enlarge the apparatus in the axial direction of the toner bottle.

An object of the present invention is to eliminate the previously described disadvantages by providing a toner replenishment device which does not cause damage to the drive system even when a user mistakenly rotates a completely installed toner bottle, and without enlarging the toner replenishment device.

Another object of the present invention is to provide a toner replenishment device having excellent bottle rotation response after linkage when a toner bottle is connected to drive system linkage by an installation operation even when the toner bottle is installed such that the connection of the toner bottle and the drive system is incomplete when said toner bottle is installed in said device.

In the conventional toner replenishment device disclosed in Japanese Patent No. 6-95248, a disadvantage arises inasmuch as the rotational drive of the toner bottle is transmitted through a coupling and the toner bottle is not directly driven in rotation. Therefore, when the rotational torque of the toner bottle increases, the toner bottle slips from the coupling and cannot be adequately driven.

An object of the present invention is to provide a toner replenishment device capable of reliably transmitting a drive force to the toner bottle by rotating a coupling to a fixed position even when a toner bottle is not installed.

A still further object of the present invention is to provide a toner replenishment device capable of installing a toner bottle on a coupling without error.

SUMMARY OF THE INVENTION

The aforesaid objects are attained by the toner replenishment device of the present invention comprising a toner bottle, coupling for supporting said toner bottle, drive member for engaging the drive connector of said toner bottle inserted in said coupling, and drive unit for transmitting a rotational force to said drive member and said coupling. Thus, unnecessary force is not applied to the support of the toner bottle because the rotational drive force is not received from the coupling supporting the toner bottle. Furthermore, since a drive force is transmitted to the coupling even when a toner bottle is not installed, the coupling which is not at the fixed position can be rotated to the fixed position to allow the toner bottle to be installed or removed. Since a sensor is provided to detect arrival at the fixed position, the coupling can be stopped at the fixed position.

The toner bottle of the present invention engages a connector provided on a coupling, and is provided with at least two connector projections on lateral surfaces and which are asymmetrical to the rotational axis. A user inserts the toner bottle into a coupling stopped at a fixed position, and the coupling and toner bottle are connected via a connector which is 180° asymmetrical to the rotational axis, such that the connection between the coupling and toner bottle is not only at a specific position, but such that the toner bottle can be positioned to the fixed position.

The toner replenishment device of the present invention is provided with a drive member for engaging the toner bottle to a drive connector unit, and a drive unit for transmitting a rotational force to said drive connector via a torque limiter. Since the torque limiter is provided between the drive member and a driveshaft, when a rotational force exceeding a predetermined value is input from the bottle to the drive unit, the torque limiter is operated such that said force is not transmitted to the motor or drive shaft.

The toner replenishment device of the present invention is further provided with a drive member for engaging the drive connector unit of the toner bottle, and a drive unit for supporting said drive member so as to be freely detachable and for transmitting a rotational force to said drive member. Therefore, when a toner bottle is at a position at which said toner bottle has not engaged said drive member during installation of the toner bottle, the toner bottle is installed with the drive unit retracted in the opposite direction of the toner bottle because the connectors strike one another causing the connector rib of the toner bottle to push against the connector of the drive member, and thereafter the drive member returns via the rotational drive of the drive shaft so as to reliably produce a connection between the connector of the toner bottle and the drive member.

The toner bottle of the present invention is further provided with a toner replenishment aperture at one end thereof, concavities, and ribs for the drive connection into said concavities. The shape of the toner bottle is not increased because the connectors are provided within the concavities of the toner bottle.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

The preferred embodiments of the present invention are described hereinafter with reference to the accompanying drawings.

Figure 1:
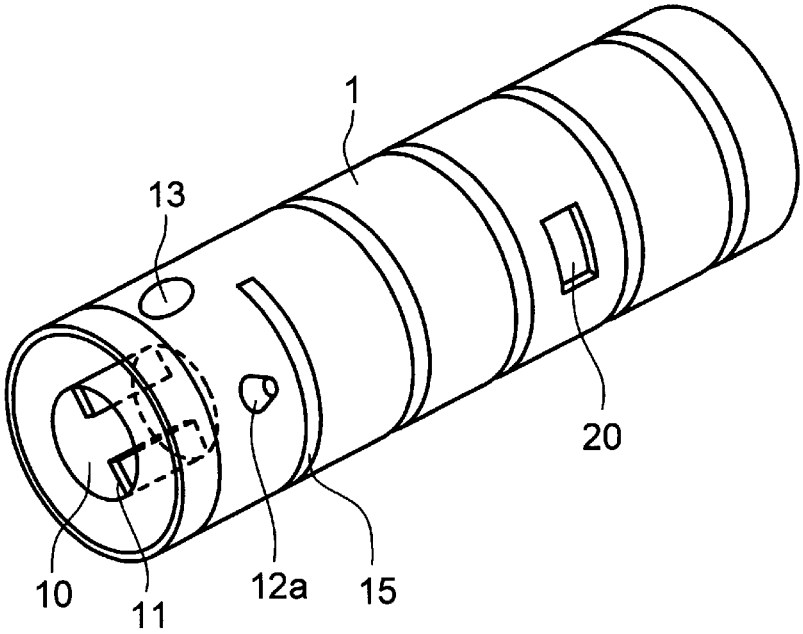
FIG. 1 is a perspective view of the toner bottle of the present invention.

FIG. 1 is a perspective view of toner bottle (1). Toner bottle (1) is cylindrical in shape, and is provided with a spiral projection (15) to the interior thereof. A toner supply aperture (13) is provided near an end of toner bottle (1) for discharging toner accommodated within the bottle to the exterior thereof. Connector projections **(12*a*) and (12*b*) for drive connection are provided relative to the rotational axis on the exterior surface near an end of toner bottle (1). An indentation (20) is provided in part of the center section of toner bottle (1)**.

Figure 2:
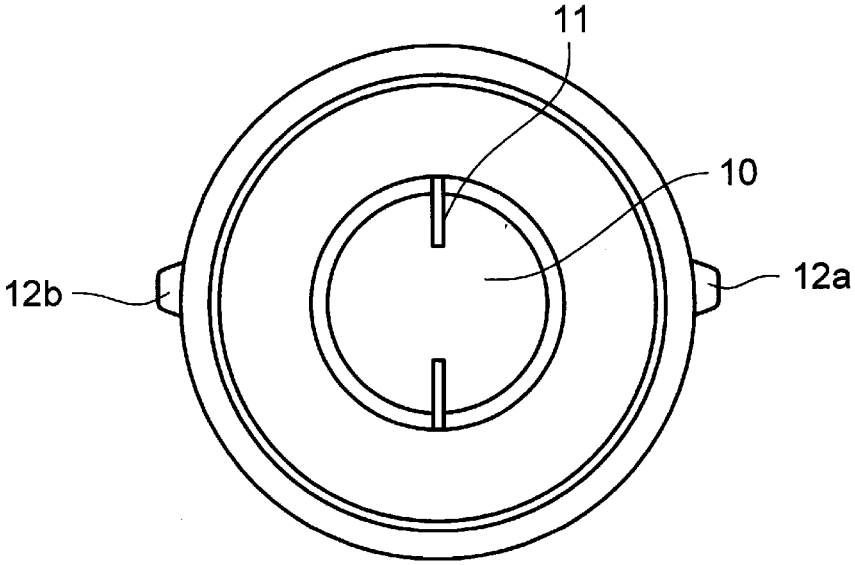
FIG. 2 is a left side view of the toner bottle of the present invention.
Figure 3:
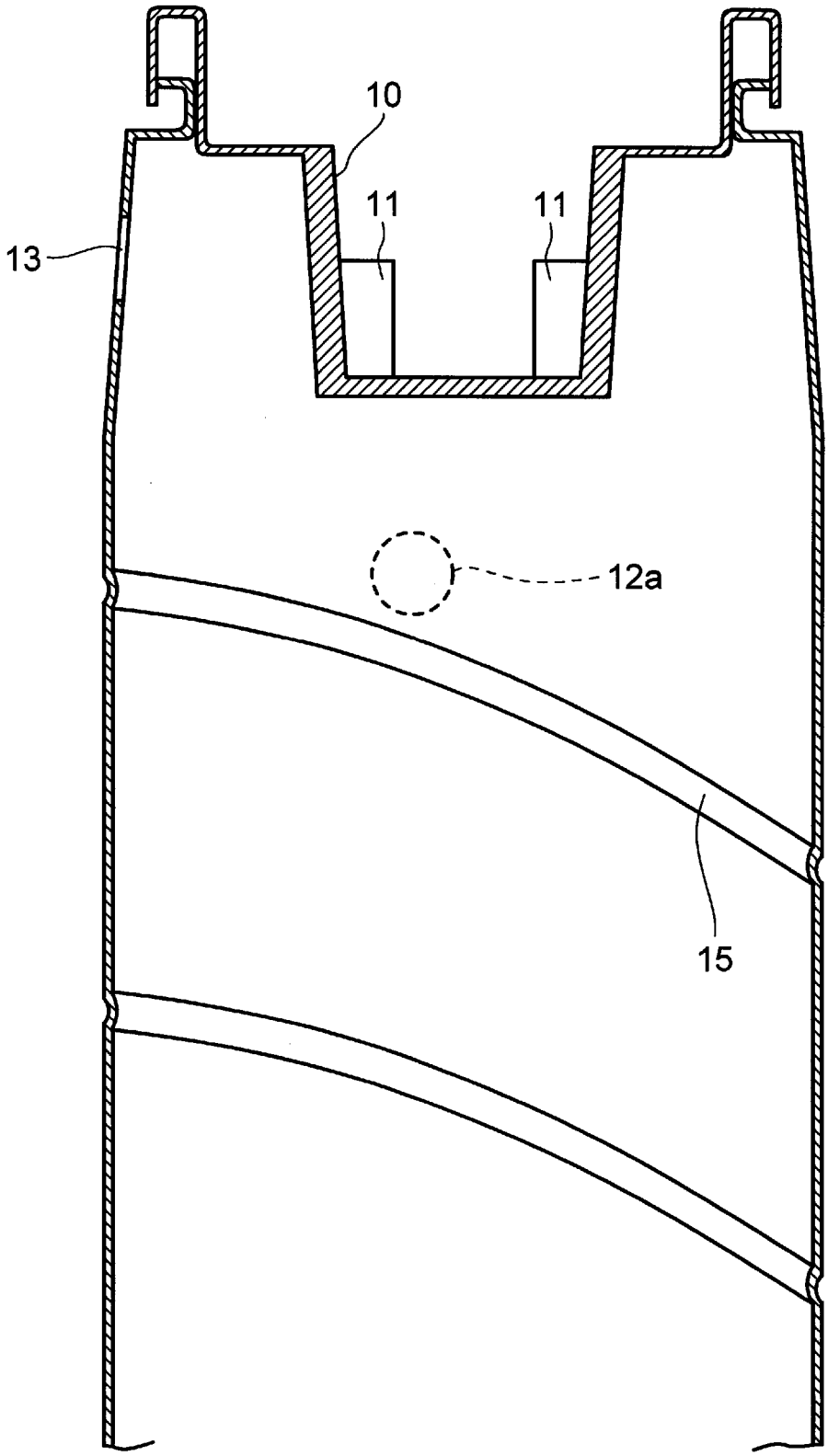
FIG. 3 is a longitudinal section view of the concavities of the toner bottle of the present invention.

FIG. 2 is a front view of toner bottle (1), and FIG. 3 is a section view of the essential portion thereof. A concavity (10) in the form of a circular cone configuration is indented toward the interior of the container at the endface on the toner resupply aperture (13) side. The interior diameter of concavity (10) is smaller than the interior diameter of the container body, and the bottom surface of concavity (10) is indented to a position which exceeds the toner resupply aperture (13). Ribs (11) are formed on concavity (10) and extend from the interior surface in the central axis direction and the end of said ribs (11) contact the bottom surface of said concavity (10).

The toner bottle (1) of the aforesaid construction is installed in a toner replenishment device described later via rotation by a drive mechanism. Toner accommodated within the toner bottle (1) is transported along the spiral projection (15) toward toner resupply aperture (13) in conjunction with the aforesaid rotation, and said toner drops into a developing device provided below the toner replenishment device supporting the toner bottle (1) when toner resupply aperture (13) is facing downward.

Figure 4:
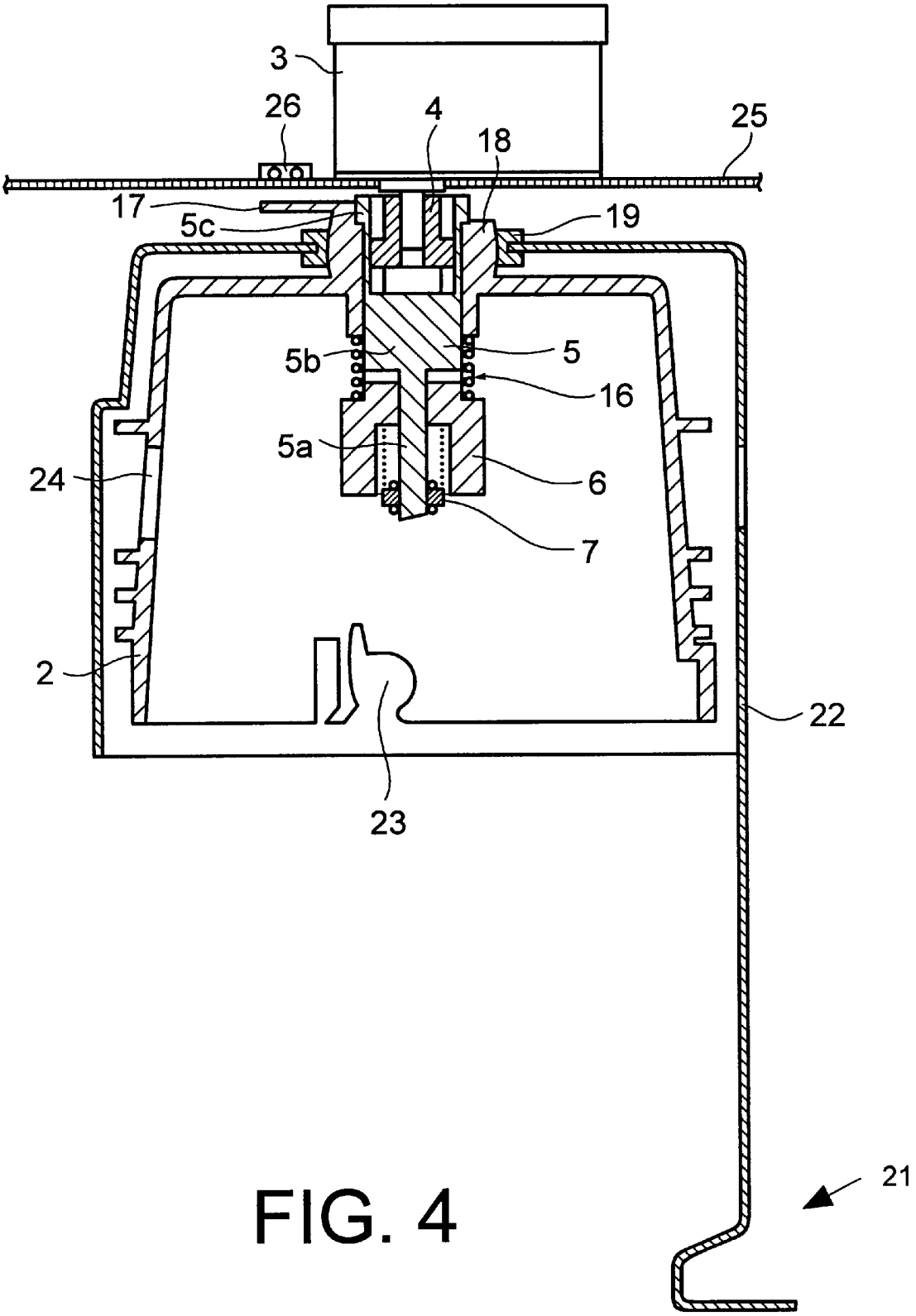
FIG. 4 is a longitudinal section view of the toner replenishment device of the present invention.

FIG. 4 is a section view of the essential part of a toner replenishment device provided in an image forming apparatus such as a copier, printer or the like. The toner replenishment device comprises a hopper (22), coupling (2) provided within hopper (22), and a motor (3). Hopper (22) and motor (3) are supported on a frame (25).

Coupling (2) is cup-shaped and has an opening for the insertion of toner bottle (1), and the interior surface of said opening is slightly larger than the exterior surface of the toner bottle (1).

The center portion of the side endface of coupling (2) projects bank-like to the opposite side of the opening to form a spherical shaft (18). Coupling (2) is supported by hopper (22) so as to be freely rotatable by having spherical shaft (18) engage a spherical bearing (19) provided on hopper (22). Spherical bearing (19) holds spherical shaft (18) at an inclination even in rotation. A shield panel (17) for detecting the standard position of coupling (2) is provided at one end of spherical shaft (18) on the motor (3) side, and a sensor (26) for detecting shield panel (17) is provided on frame (25).

A hole is provided at the center of the endface of coupling (2), and a driveshaft (5) is inserted therethrough.

Figure 5:
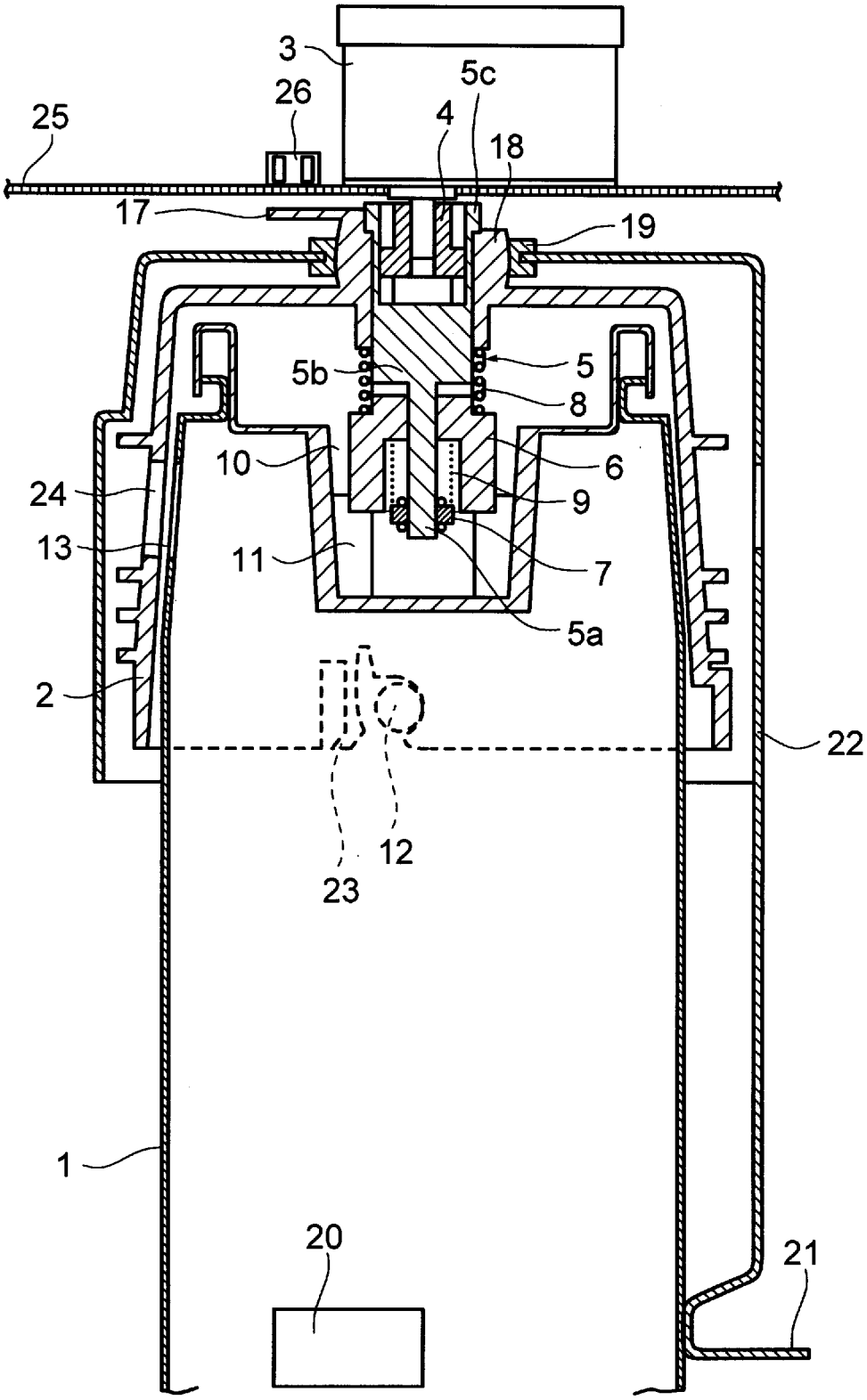
FIG. 5 is a longitudinal section view of the toner bottle installed in the toner replenishment device of the present invention.

FIG. 5 shows toner bottle (1) inserted into coupling (2) from the left side of the drawing.

Connectors (23) and (23) for engaging the connector projections **(12*a*) and (12*b*) on the exterior surface of toner bottle (1) are provided on end of coupling (2) on the toner bottle installing side so as to be asymmetrical relative to the rotational axis. When toner bottle (1) is inserted into coupling (2), the connector projections (12*a*) and (12*b*) of toner bottle (1) engage the connectors (23) and (23) of coupling (2), such that the toner bottle (1) is supported by coupling (2)**.

A toner resupply aperture (24) is provided near the end of coupling (2) and corresponds to the toner resupply aperture (13) on toner bottle (1) when toner bottle (1) is installed. A toner resupply aperture is also provided near the end of hopper (22) at a position corresponding to the time toner resupply apertures (13) and (24) face directly downward when toner bottle (1) one coupling (2) are rotated. Accordingly, when toner bottle (1) and coupling (2) are rotated via a drive mechanism described later such that the toner resupply apertures (13) and (24) face directly downward, said toner resupply apertures are aligned and toner within toner bottle (1) falls toward a developing device provided below hopper (22).

A driveshaft (5) is connected to motor (3) via a drive linkage (4), and the rotation of motor (3) is transmitted to driveshaft (5) via said drive linkage (4). Drive linkage (4) comprises a universal joint capable of drive transmission even when the rotational axis center of motor (3) and the rotational axis center of driveshaft (5) are inclined.

Figure 6:
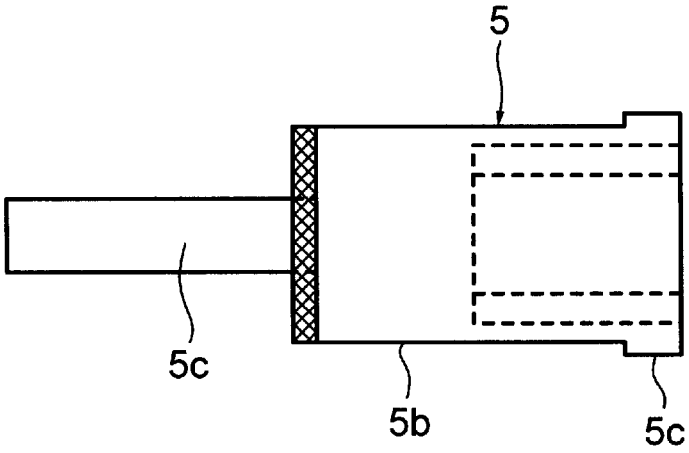
FIG. 6 is a side view of the driveshaft of the present invention.

FIG. 6 is a side view of driveshaft (5). The center portion of driveshaft (5) forms a center shaft part (5*b*) having a diameter identical to the interior hole diameter of coupling (2). Drive shaft (5) is supported by center shaft (5*b*) so as to be freely rotatable relative to coupling (2) and slidable in the direction of the rotational axis.

A thick shaft part (5*c*) having a diameter greater than the interior hole diameter of coupling (2) is formed near the end of driveshaft (5) on the motor (3) side, such that driveshaft (5) is prevented from passing through the hole in coupling (2) on the toner bottle side.

A narrow shaft part (5*a*) having a diameter less than the internal diameter of the hole of coupling (2) is formed near the end of driveshaft (5) at a position on the toner bottle (1) side. A drive member (6) for transmitting a rotational force to toner bottle (1) is supported by narrow shaft part (5*a*) so as to be freely rotatable relative to said narrow shaft part (5*a*).

A drive unit retraction spring (8) is provided on the exterior surface of the center shaft part (5*b*) of drive shaft (5), one end of said drive unit retraction spring (8) engaging coupling (2), the other end engaging drive member (6). The driveshaft (5) is forced toward the toner bottle (1) side by means of the drive unit retraction spring (8), such that the thick shaft part (5*c*) of the driveshaft (5) is pressed against the spherical shaft (18) of the center part of the endface on the coupling (2) side.

Figure 7:
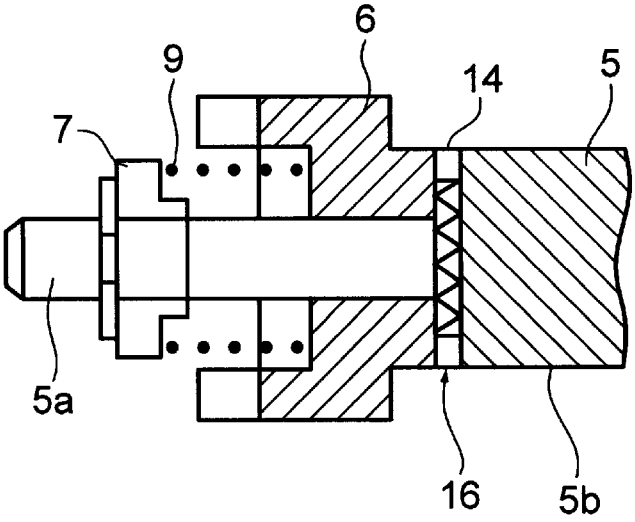
FIG. 7 is an enlargement (normal state) of the torque limiter in the toner replenishment device of the present invention.
Figure 8:
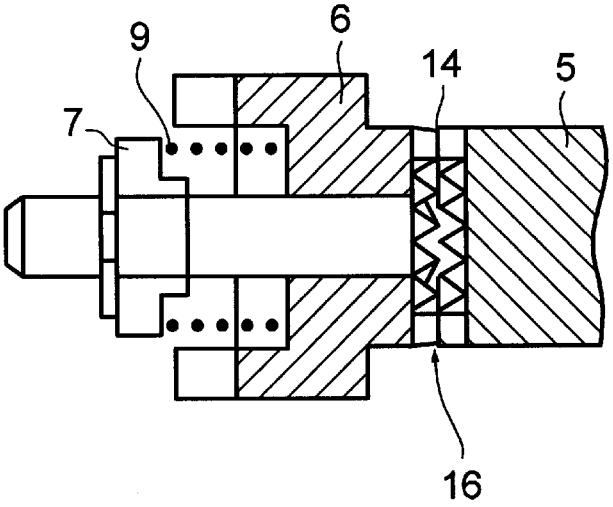
FIG. 8 is an enlargement (torque limiter operating state) of the torque limiter in the toner replenishment device of the present invention.

FIGS. 7 and 8 are section views showing the essential parts of driveshaft (5) on the toner bottle side. The rotational force of driveshaft (5) is transmitted by a torque limiter (16). Torque limiter (16) comprises a torque limiter operation unit (14), torque limiter spring (9), and spring bearing (7).

Torque limiter operation unit (14) is provided at the interface of the part opposite drive member (6) and center shaft part (5*b*) of driveshaft (5), i.e., the part of the difference in level producing a difference in the axial system of the narrow shaft part (5*a*) and the center shaft part (5*b*) of driveshaft (5), on the center shaft part (5*b*) side of drive member (6) in contact with said part. Teeth are provided on the periphery of the rotational axis center of said surfaces so as to be mutually engaged.

Spring bearing (7) is fixedly attached near the tip of the narrow shaft part (5*a*) of driveshaft (5), and receives one end of the torque limiter spring (9). Torque limiter spring (9) is provided on the exterior surface of narrow shaft part (5*a*) of driveshaft (5), and presses the drive member (6) against the center shaft part (5*b*) of driveshaft (5) so as to engage the gear teeth of torque limiter operation unit (14).

Figure 9:
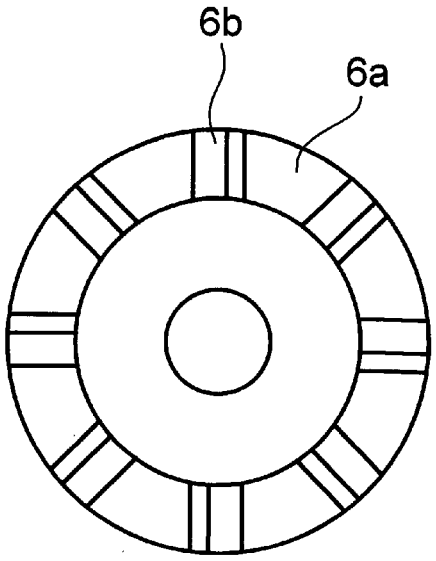
FIG. 9 is a left side view of the drive member in the torque limiter of the present invention.
Figure 10:
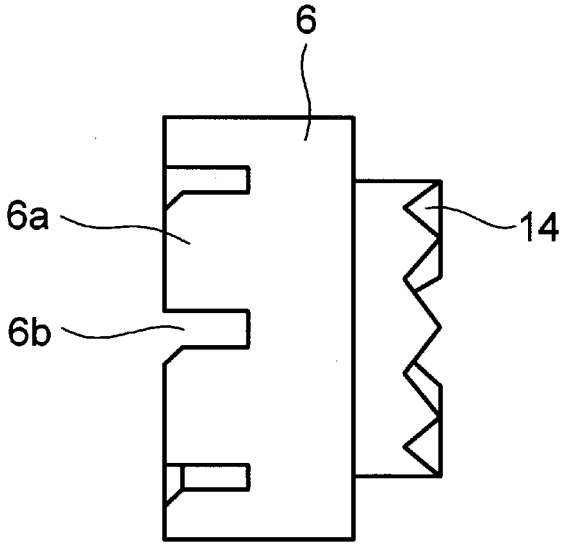
FIG. 10 is a front view of the drive member in the torque limiter of the present invention.

FIG. 9 is a front view of drive member (6), and FIG. 10 is a side view of the drive member (6). Eight connector tips (6*a*) and connectors (6*b*) are provided at point symmetries on the rotational axis on the opposite side of drive member (6) relative to torque limiter operation unit (14).

When a toner bottle (1) is installed in coupling (2), the tips of ribs (11) of toner bottle (1) abut the connector tips (6*a*) of the drive member (6). In this state, the connector projections (12*a*) and (12*b*) on the exterior surface of the toner bottle (1) do not engage the connectors (23) and (23) of coupling (2). When the toner bottle (1) is pressed to the coupling (2) side for the connector projections (12*a*) and (12*b*) to engage the connectors (23) and (23), the drive member (6) is pressed against the rib (11), and driveshaft (5) is shifted in the direction of motor (3) against the force of the drive unit retraction spring (8). Thus, the connector projections (12*a*) and (12*b*) on the exterior surface of toner bottle (1) can engage the connectors (23) and (23) of coupling (2) against the force of the drive unit retraction spring (8), and the toner bottle (1) is installed in coupling (2). Since the drive member (6) is retracted by the shift of the driveshaft (5) in the axial direction, damage to the toner bottle (1) and the drive member (6) is prevented when installing the toner bottle (1).

Motor (3) operates based on the output of a toner density detection sensor not shown in the illustrations. When toner bottle (1) is installed in coupling (2), the rotation of motor (3) is transmitted to the drive member (6) via the drive linkage (4), driveshaft (5), and part of torque limiter (16) so as to rotate the drive member (6).

When drive member (6) is rotated, the ribs (11) of toner bottle (1) fit into the connector (6*b*) along a tapered portion provided on the connector (6*b*) of drive member (6), such that the driveshaft (5) is shifted to the toner bottle (1) side by the force of the drive unit retraction spring (8). Thus, the ribs (11) of toner bottle (1) reliably engage the connector (6*b*) of drive member (6). In this state, the ribs (11) of toner bottle (1) press the connector (6*b*) of drive member (6) in the direction of motor (3) without the thick shaft part (5*c*) of driveshaft (5) pressing against the spherical shaft (18).

At this time, coupling (2), relative to driveshaft (5), only abuts a freely oscillating driveshaft (5) in the hole provided in coupling (2). Therefore, the rotation of driveshaft (5) is not transmitted to rotation of coupling (2).

On the other hand, since the connector projections (12*a*) and (12*b*) of toner bottle (1) engage the connectors (23) and (23) of coupling (2), said coupling (2) is rotated synchronously with the rotation of toner bottle (1). In this way, enlargement of the overall toner replenishment device can be avoided by the aforesaid connection within the concavities of the toner bottle.

When a load less than a predetermined value is exerted on toner bottle (1) during the rotation of said toner bottle (1), a friction force is generated in the torque limiter operation unit (14) because the drive member (6) is pressed against the driveshaft (5) by the torque limiter spring (9), and the drive motor (3) and toner bottle (1) are in a directly connected state insofar as said drive force does not exceed said friction force. The state of the torque limiter (16) at this time is shown in FIG. 7.

The torque limiter operates when a load exceeding a predetermined value is exerted on the drive system, e.g., when a user or operator mistakenly rotates a toner bottle (1) installed in the toner replenishment device. The state of the torque limiter (16) at such a time is shown in FIG. 8. At this time, the drive force exceeds the friction force; the torque limiter spring (9) is compressed in the direction of the toner bottle, and only drive member (6) is rotated, such that a drive force is not transmitted to the driveshaft (5). Accordingly, damage to drive motor (3) and the drive system can be prevented.

Since the drive force of motor (3) is not transmitted directly to coupling (2) when a toner bottle (1) is installed, when a load is applied to toner bottle (1) to cause the operation of torque limiter (16), the coupling (2) does not rotate when the toner bottle does not rotate.

When a toner bottle (1) is not installed, the driveshaft (5) is pressed in the direction of toner bottle (1) by the drive unit retraction spring (8) pressing against the drive member (6) and the interior wall of coupling (2), such that the thick shaft part (5*c*) of drive shaft (5) is comes into contact with the spherical shaft (18) of coupling (2). Therefore, when a drive force is transmitted from motor (3) to driveshaft (5) when a toner bottle (1) is not installed, the coupling (2) is rotated by the friction produced between coupling (2) and thick shaft Part (5*c*) in conjunction with the force providing rotation of driveshaft (5).

When a shield panel (17) provided on spherical shaft (18) arrives at a position sensor not shown in the illustration, the rotation of motor (3) is stopped, and coupling (2) is stopped at the home position.

The home position of coupling (2) is a position at which the toner resupply aperture provided in coupling (2) is facing upward. When the toner resupply aperture is facing downward, the resupply aperture of the toner bottle (1) also faces downward and must be installed in coupling (2). When the resupply aperture of toner bottle (1) faces downward, toner may spill out and soil the vicinity if the toner bottle (1) is removed. Toner will not spill, however, if the coupling (2) stop position is such that the resupply aperture is facing upward.

Furthermore, since the connector projections (12*a*) and (12*b*) of toner bottle (1) are asymmetrical relative to the rotational axis, the toner resupply aperture of toner bottle (1) is reliably positioned at the position of the resupply aperture of coupling (2).

When toner bottle (1) is not installed, the rotational drive of coupling (2) is a drive generated by the friction between the thick shaft part (5*c*) of driveshaft (5) and the spherical shaft (18), and the load is absorbed by the friction face and not transmitted to driveshaft (5) even when the load exerted on coupling (2) exceeds a predetermined value. Since the rotational drive is delivered via the torque limiter (16) when a toner bottle (1) is installed, a load exceeding a predetermined value exerted on coupling (2) is absorbed by torque limiter (16) and is not transmitted to driveshaft (5). Accordingly, damage to drive motor (3) and the drive system can be prevented.

When toner bottle (1) is rotated, the toner accommodated therein is transported along the spiral projections (15) toward the toner resupply aperture (13) to resupply toner.

A protrusion (21) is provided on the hopper and supports toner bottle (1) below the resupply aperture side such that the end opposite the coupling (2) is inclined upward slightly. When the toner bottle (1) is rotated, the protrusion (21) is inserted in the indentation (20) provided on a part of the center portion of the toner bottle. Toner accommodated within the toner bottle (1) is prevented from adhering to the interior walls of toner bottle (1) by the vibration produced due to the difference in level of the indentation (20). Indentation (20) does not have a difference in level relative to the direction of rotation, does not hinder the rotation of the toner bottle (1), and gradually inclines toner bottle (1) below the resupply aperture side.

In the present embodiment, two ribs (11) of the toner bottle are provided at point symmetry on the rotational axis of the bottle. In contrast, there are eight connectors (6*b*) provided n the drive member (6) in point symmetry on the rotational axis. Therefore, there are four places which are positions of possible connection, such that engagement is realized by slight rotation (time) after operation of the replenishment device even when the retraction mechanism is operated and drive member (6) is retracted due to insufficient engagement. Furthermore, rotation response is improved by minimizing the play of toner bottle (1) and drive member (6) in the direction of rotation. The number of ribs (11) of the toner bottle may be three or more, and the number of drive member connectors (6*b*) may be an integer multiple of the number of positions of possible connections corresponding to the number of said ribs (11).

Although the present invention has been described in terms of a cylindrical toner bottle having spiral protrusions the interior thereof, the present invention is not limited to this configuration, and may be adapted to configurations capable of resupplying toner by rotation, e.g., a bottle of normal shape, bottle of circular cone shape, bottle of barrel shape, bottle of polygonal pyramid shape, bottle of polygonal prism shape and the like.

A connector was used to connect the drive member and the toner bottle ribs in the aforesaid embodiment, but the present invention is not restricted to such configuration inasmuch as, for example, such connection may be accomplished by a concavity on the toner bottle and convexity on the drive member.

Although the a coil spring was used as the spring in the aforesaid embodiment, it is to be noted that the present invention is not limited to this arrangement insofar as a member having elasticity may be used, and a flat spring or macromolecular elastomer (elastic rubber) may be used. Furthermore, although the connector projections (12*a*) and (12*b*) and connectors (23) and (23) fixedly attached to toner bottle (1) and coupling (2) were connected at two places, the present invention is not restricted to this arrangement. The toner bottle (1) and coupling (2) cannot be positioned when the connection is at an object position relative to the rotational axis. However, since the toner bottle (1) can be connected to coupling (2) at an inclination so as to quickly connect when biased in a direction relative to the axis, a position slightly shifted from the axial object position is desirable.

According to the preceding description, the present invention provides that a drive unit directly rotates a toner bottle when a toner bottle is installed, and a drive force is transmitted by a coupling when a toner bottle is not installed, so as to allow a toner bottle to be installed and removed by rotating a coupling to a fixed position.

The present invention prevents damage to the driveshaft and drive motor when a toner bottle is mistakenly rotated by an operator.

Furthermore, damage to the drive system can be prevented by providing a drive unit retraction mechanism without requiring precise positioning of the drive member when installing a toner bottle, and insufficient rotation can be prevented by accomplishing connection of the drive member and toner bottle by operating the device.

The overall toner replenishment device is designed to conserve space because the toner bottle is not enlarged.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A toner replenishment device comprising;

a toner bottle which accommodates toner, said toner bottle having a concavity, and a drive connector disposed within said concavity, a coupling onto which said toner bottle is detachably connected and which supports the toner bottle, said coupling including a drive member which is in engagement with the drive connector of said toner bottle, and a driving unit including a drive member in engagement with the drive connector of said toner bottle, said driving unit transmitting a rotational force to said drive member and said coupling to rotate said toner bottle.

2. The toner replenishment device as claimed in claim 1, wherein said drive member has a claw, and said drive connector has a rib.

3. The toner replenishment device as claimed in claim 2, wherein said claw and rib engage each other when said coupling is attached to said toner bottle.

4. The toner replenishment device as claimed in claim 1, wherein said driving unit transmits a rotational force to said coupling when said toner bottle is not supported by said coupling, and said driving unit transmits a rotational force to said drive member when said toner bottle is supported by said coupling.

5. The toner replenishment device according to claim 1, wherein said toner bottle further comprises projections adapted for engagement by said coupling, said projections sticking out on lateral surfaces of said toner bottle.

6. A toner replenishment device comprising;

a toner bottle which accommodates toner, said toner bottle having a drive connector, a coupling onto which said toner bottle is detachably connected and which supports the toner bottle, a driving unit including a drive member which is in engagement with the drive connector of said toner bottle, and a sensor for detecting the predetermined position of said coupling, wherein at the predetermined position the coupling can receive the toner bottle.

7. A toner replenishment device comprising;

a toner bottle which accommodates toner, said toner bottle having a drive connector, a coupling onto which said toner bottle is detachably connected and which supports the toner bottle, a driving unit including a drive member which is in engagement with the drive connector of the toner bottle, said driving unit transmits a rotational force to said coupling and said drive member to rotate said toner bottle, and wherein said drive unit for transmitting a rotational force to said drive member has a torque limiter.

8. The toner replenishment device according to claim 7, wherein said toner bottle further comprises projections adapted for engagement by said coupling, said projections sticking out on lateral surfaces of said toner bottle.

9. The toner replenishment device as claimed in claim 8, wherein said drive member has a claw, and said drive connector has a rib.

10. The toner replenishment device as claimed in claim 9, wherein said claw and rib engage each other when said projections engage said coupling.

11. A toner replenishment device comprising;

a toner bottle which accommodates toner, and said toner bottle includes a drive connector, a supporting means for supporting said toner bottle, a drive claw for engaging the drive connector of said toner bottle, and a drive unit for transmitting a rotational force to said drive claw, said drive unit including a torque limiter.

12. The toner replenishment device according to the claim 11, wherein said supporting means comprises a coupling and projections.

13. The toner replenishment device according to claim 12, wherein said projections project on lateral surfaces of said toner bottle.

14. The toner replenishment device comprising;

a toner bottle which accommodates toner, said toner bottle having a concavity, and a drive connector disposed within said concavity, a supporting means for supporting said toner bottle, a drive member for engaging the drive connector of said toner bottle, said drive member having a claw, and a drive unit for supporting said drive claw in a freely detachable manner and for transmitting a rotational force to said drive claw.

15. The toner replenishment device as claimed in claim 14, wherein said drive connector has a rib.

16. The toner replenishment device as claimed in claim 14, wherein said claw and rib engage each other when said supporting means supports said toner bottle.

17. The toner replenishment device according to the claim 14, wherein said supporting means comprises a coupling and projections.

18. The toner replenishment device according to claim 17, wherein said projections project on lateral surfaces of said toner bottle.

19. A toner replenishment device comprising;

a toner bottle including a toner replenishment aperture and a concavity at one end thereof, a drive connection within said concavity, said drive connection including at least one rib, a supporting means for supporting said toner bottle, a drive claw for engaging said at least one rib of said toner bottle, and a drive unit for supporting said drive claw in a freely detachable manner and for transmitting a rotational force to said drive claw.

20. The toner replenishment device according to the claim 19, wherein said supporting means comprises a coupling and projections.

21. The toner replenishment and device according to claim 20, wherein said projections project on lateral surfaces of said toner bottle.

22. A toner bottle which accommodates toner adapted for detachable connection to an image forming apparatus comprising, a toner replenishment aperture at one end of said toner bottle, a concavity having a drive connector adapted to receive a driving member of the image forming apparatus when the toner bottle is inserted into the image forming apparatus, and said toner bottle including projections adapted to engage a coupling.

23. The toner bottle according to the claim 22, wherein said projections stick out on lateral surfaces of said toner bottle.

24. The toner bottle according to the claim 22, wherein said drive connector has a rib.

* * * * *